US011718377B2

(12) United States Patent
Garthwaite

(10) Patent No.: US 11,718,377 B2
(45) Date of Patent: Aug. 8, 2023

(54) ROBOTIC EEL

(71) Applicant: Fishboat Incorporated, Bainbridge Island, WA (US)

(72) Inventor: Martin Spencer Garthwaite, Bainbridge Island, WA (US)

(73) Assignee: Fishboat Incorporated, Bainbridge Island, WA (US)

( * ) Notice: Subject to any disclaimer, the term of this patent is extended or adjusted under 35 U.S.C. 154(b) by 71 days.

(21) Appl. No.: 17/222,965

(22) Filed: Apr. 5, 2021

(65) Prior Publication Data

US 2021/0221488 A1 Jul. 22, 2021

Related U.S. Application Data

(63) Continuation of application No. 15/942,545, filed on Apr. 1, 2018, now Pat. No. 10,967,944.

(60) Provisional application No. 62/480,167, filed on Mar. 31, 2017.

(51) Int. Cl.

| | |
|---|---|
| ***B63H 1/37*** | (2006.01) |
| ***B63H 1/36*** | (2006.01) |
| ***B63G 8/08*** | (2006.01) |

(52) U.S. Cl.
CPC ..... *B63H 1/37* (2013.01); *B63G 8/08* (2013.01); *B63H 1/36* (2013.01)

(58) Field of Classification Search
CPC ... B63H 1/00; B63H 1/36; B63H 1/37; B63G 8/00; B63G 8/001; B63G 8/08; B63G 8/18
USPC ..... 440/13, 14, 15
See application file for complete search history.

(56) References Cited

U.S. PATENT DOCUMENTS

| | | | | |
|---|---|---|---|---|
| 6,138,604 | A * | 10/2000 | Anderson | B63H 1/36 440/15 |
| 10,967,944 | B2 * | 4/2021 | Garthwaite | B63H 1/36 |
| 2016/0304179 | A1 * | 10/2016 | Garthwaite | B63H 1/36 |

* cited by examiner

*Primary Examiner* — Lars A Olson

(57) ABSTRACT

A robotic eel may comprise a plurality of torque reaction engines, an inertial mass, and a fin. Each of the plurality of torque reaction engines oscillates an inertial mass about an axis, producing a torque reaction on and oscillation of an external shaft. Oscillation of the external shaft bends a beam of the robotic eel. Bending the beam of the robotic eel produces at least one of a traveling or a standing wave in the beam. The traveling wave may be communicated to a second torque reaction of the plurality of torque reaction engines and to the fin, producing thrust.

10 Claims, 4 Drawing Sheets

ROBOTIC EEL

CROSS REFERENCE

This application is a non-provisional, incorporates the subject matter, and claims the benefit of U.S. provisional patent application Ser. No. 62/480,167, filed on Mar. 31, 2017, and is a continuation of, incorporates the subject matter, and claims the benefit of U.S. patent application Ser. No. 15/942,545, filed on Apr. 1, 2018.

BACKGROUND

U.S. patent application Ser. No. 15/101,901 discloses a torque reaction engine (TRE), use of which in a watercraft achieves a fish-like motion. The resulting craft swims like a fish or marine mammal, without the myriad parts that plague other mechanical craft that attempt to swim like a fish or marine mammal.

At times it may be desirable to swim in other modes, such as like an eel. Eels swim by generating body waves, wherein the body waves travel the length of their bodies.

SUMMARY

Figure 1:
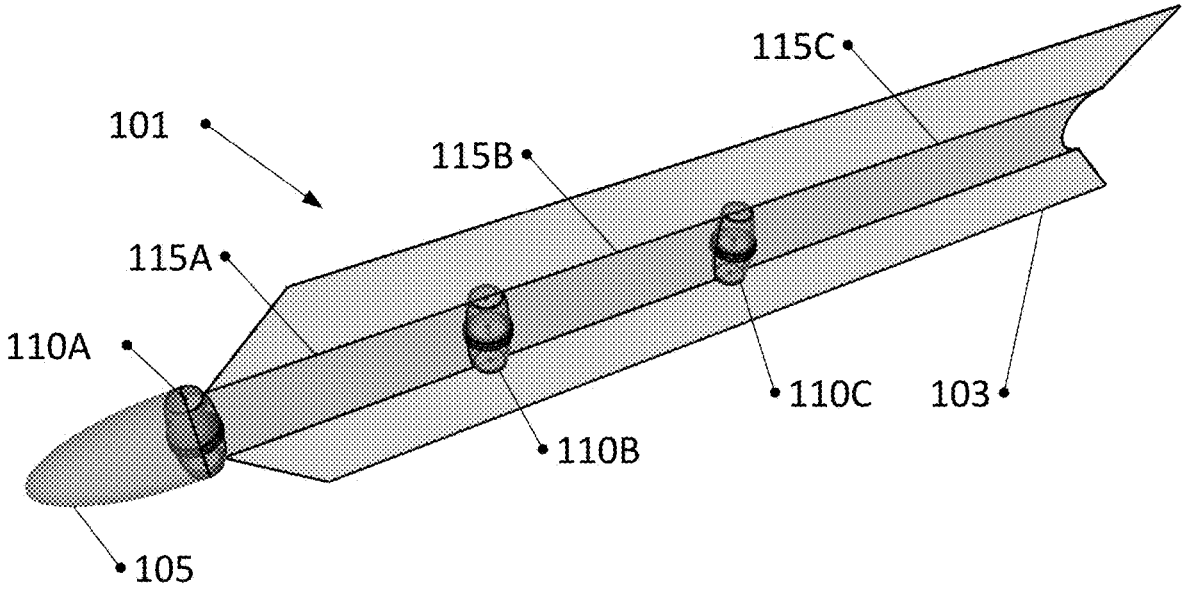
FIG. 1 illustrates a robotic eel with more than one torque reaction engine ("TRE").

Certain of the inventions disclosed herein comprise systems and apparatus to accelerate thrust fluid and to produce thrust like an eel, through use of a plurality of TREs.

DETAILED DESCRIPTION

It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

The figures and text therein illustrate and discuss examples of a craft that accelerates thrust fluid and achieves thrust like an eel, through use of more than one torque reaction engine (TRE).

As discussed herein, "thrust fluid" comprises a gas, a liquid, a plasma or other media comprising mass, wherein the media may be accelerated by a moving fin, propeller, or the like ("fin"), and wherein the fin may be moved by a motor or wherein the thrust fluid is of a stream of thrust fluid and the stream of thrust fluid moves the fin.

As discussed herein, each TRE comprises an external shaft connected to a portion of a hull and/or beam of a craft ("beam"), an inertial mass located around or within the external shaft of an engine, wherein the engine may be located between and/or may comprise the inertial mass and the external shaft. The engine causes the inertial mass to change its acceleration relative to the external shaft, such as by slowing down, speeding up, or reversing rotation of the inertial mass. Torque reaction produced on the external shaft by change in acceleration of the inertial mass by the engine causes the external shaft and portion of the beam attached to such external shaft to rotate, opposite a vector of the change in acceleration of the inertial mass. Each TRE may be controlled by a controller to cyclically reverse acceleration of the inertial mass, causing the external shaft to cyclically rotate in a first direction, then in a second direction, then in the first direction, etc., so long as power is available and the controller comprises suitable instructions. Cyclic rotation in the first and second directions may be referred to herein as, "cyclic oscillation".

A flexible material of or connected to the portion of the beam attached to the external shaft may flex in response to movement of the external shaft. Such flex may compress and/or expand the flexible material, such as between at least first and second shapes. The flexible material may store energy as it compresses or expands. The flexible material may release stored energy and return to an original or resting shape, as may occur when the external shaft stops experiencing a torque reaction. The flexible material may be pliable and/or may not store appreciable energy. The flexible material may transition between at least first and second shapes in response to or as allowed by movement of at least a first and a second TRE and/or in response to or as allowed by release or storage of energy in the flexible material.

The flexible material may comprise rubber, polyurethane, carbon fiber, carbon fiber embedded in resin, gelatin, gelatin produced by a living organism, fiberglass, aramid, resins, and/or the like.

The flexible material may have a first shape, wherein the first shape may comprise a unibody, a beam, or the like, wherein the first shape may be a resting shape, and/or wherein the first shape may store or comprise a different amount of energy relative to a second shape, wherein the energy may be potential energy.

The flexible material may have at least a second shape. The second shape may be a compressed, stretched, expanded, or bent version of the first shape. The second shape may store or comprise a different amount of energy relative to the first shape, wherein the energy may be potential energy.

Transition between the first and second shapes may be caused by and/or may produce a wave in the flexible material. The wave may traverse the flexible material as a traveling wave or may be a standing wave in the flexible material. The wave may store or release energy in a local portion of the flexible material. The wave may be produced by a movement, such as rotation, of at least one TRE. One TRE may move relative to at least a second TRE. The more than one TRE may be controlled to cyclically oscillate. Cyclic oscillation of the more than one TRE may be offset in phase, in frequency, and in amplitude.

A rigid material may span between the external shaft and the flexible material.

Flex of the portion of the beam may cause a traveling wave to propagate along the beam; more than one TRE may be moved relative to one another, such as when undergoing cyclic oscillation, to cause a traveling wave or a standing wave to form in at least a beam section between at least two of the TREs. Production of the traveling wave along the beam section may be performed to accelerate thrust fluid external to the robotic eel and produce thrust. Production of the standing wave may be performed to bend the beam section. Bending the beam section may be performed to steer the robotic eel. Production of the traveling wave and production of the standing wave may be performed simultaneously.

FIG. 1 illustrates robotic eel 101 with torque reaction engines TREs 110A, 110B, and 110C. The TREs are spanned by flexible material in beam section 115A, beam section 115B, and beam section 155C. A TRE such as TRE 110A may be capped by a nose, such as nose 105. For the sake of clarity, robotic eel 101 is illustrated without a skin or volume, other than nose 105 and the volume of TREs 110A, 110B, and 110C. FIG. 1 illustrates an example of fin 103; for the sake of clarity, fin 103 is not illustrated in FIG. 2.

Figure 2:
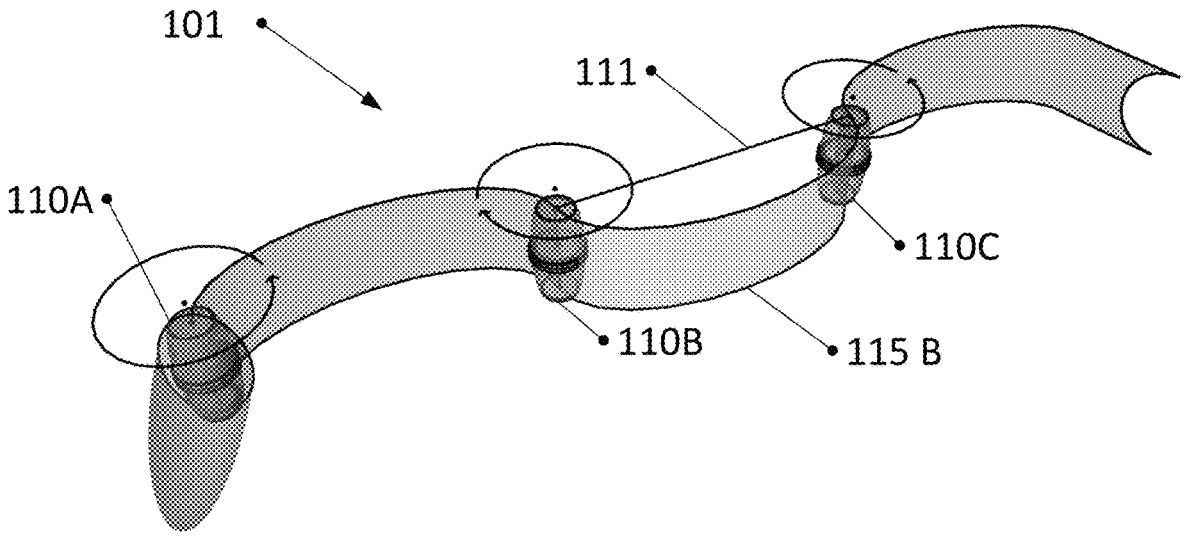
FIG. 2 illustrates the robotic eel of FIG. 1, undergoing a power cycle.

FIG. 2 illustrates robotic eel 101 of FIG. 1, undergoing a power cycle. In this power cycle, TRE 110A and TRE 110C rotate in a first direction, whereas TRE 110B rotates in a second direction. TREs of a robotic eel may be controlled by a controller to form a traveling wave or a standing wave in a beam section between the TREs. The traveling wave may be produced to accelerate thrust fluid; the standing wave may be produced to steer the robotic eel 101. The controller may control a phase of the plurality oscillation states of the plurality of TRE, an oscillation frequency for each TRE, and an oscillation amplitude for each TRE. Rotation of a first TRE relative to at least a second TRE may be slower, faster, or the same. Oscillation of a first TRE relative to at least a second TRE may be in phase, wherein the two oscillate at the same frequency and in the same direction, or may be out of phase and in oscillation frequency, wherein the first TRE is oscillating ahead or behind the other, but at the same rate or oscillation frequency. The first and second TRE may also be out of phase and out of oscillation frequency. The plurality of TRE may be operated to transmit a traveling wave up or down a length of a robotic eel.

FIG. 2 illustrates restraint 111, such as a wire, cable, or the like, that may be engaged to hold a bend in a beam section, such as in beam section 115B. This may be performed, for example, to steer or assist in steering robotic eel 101.

Figure 3:
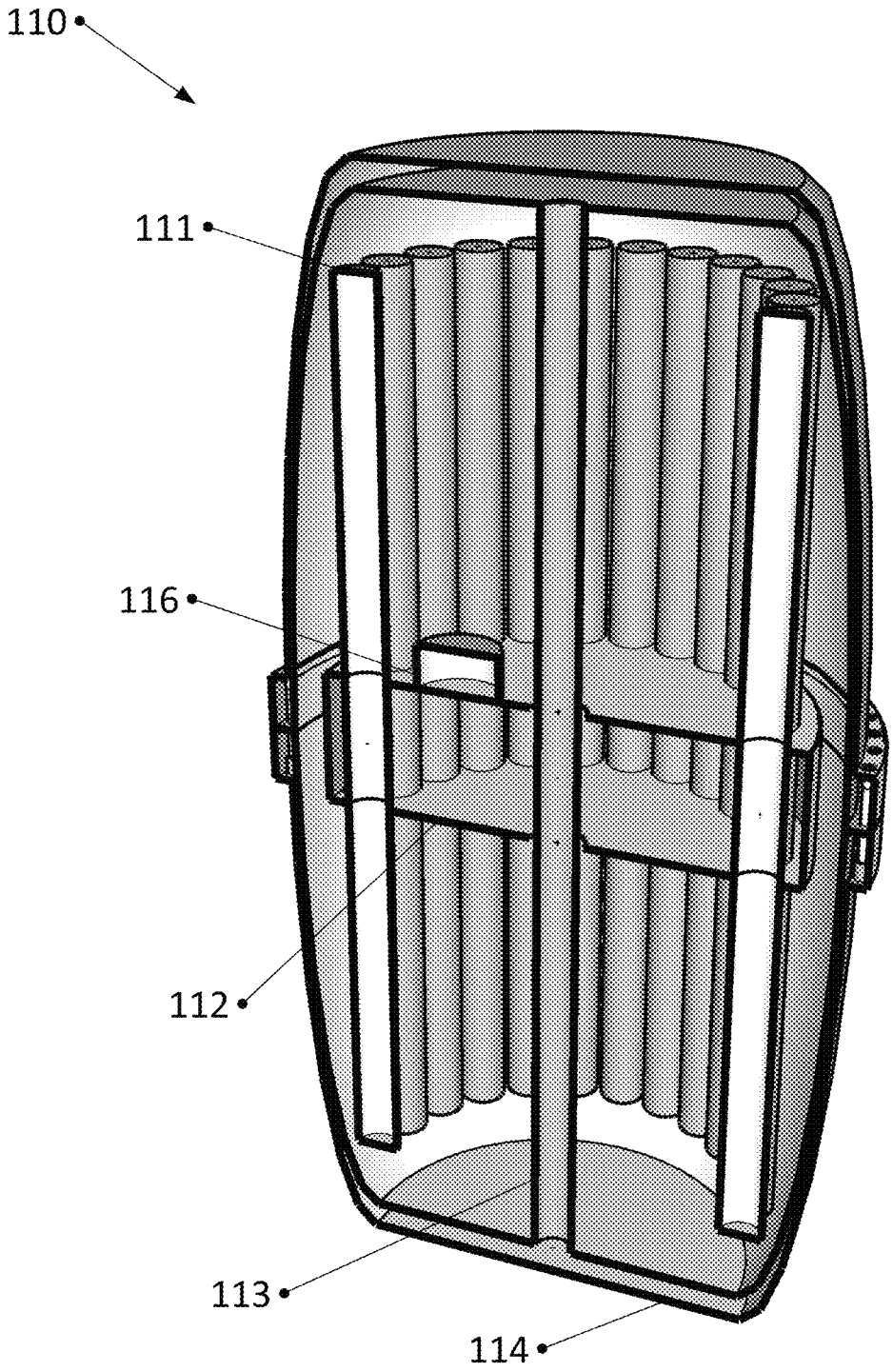
FIG. 3 illustrates an isometric section view of a TRE.

FIG. 3 illustrates an isometric section view of TRE 110. TRE 110 may comprise an inertial mass, the inertial mass may comprise batteries 111. The inertial mass may comprise or be secured to an engine 112 that may cause inertial mass to rotate about drive shaft 113, producing a torque reaction on drive shaft 113. Drive shaft 113 may be secured to external shaft 114. External shaft 114 may be secured to a beam. Engine 112 may be or comprise, for example, a piston engine or an electric engine or the like (components of which are not illustrated in FIG. 3 for the sake of clarity). Electric engines may be or comprise, for example, brushed or brushless electric engines, printed electric engines, induction electric engines, and the like.

Controller 116 may control operation of TRE 110. When a plurality of TRE 110 are present, one or more controller 116 may act to control one or all of such plurality of TRE 110.

Figure 4:
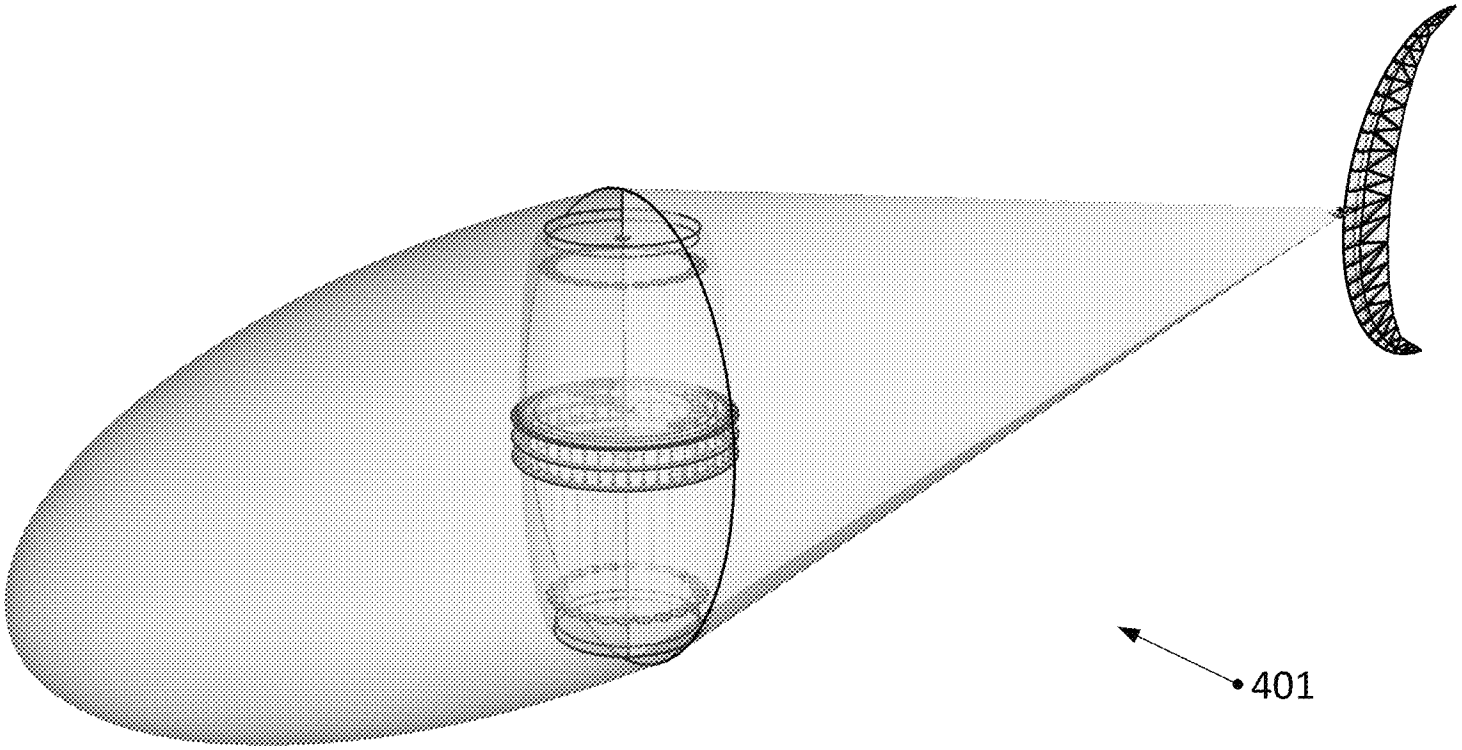
FIG. 4 illustrates a robotic fish with a TRE.

FIG. 4 illustrates robotic fish 401 with a fish-like shape and a TRE generally similar to TRE 110.

A robotic eel or fish may be programmed to identify or receive information regarding currents at different depths in a surrounding thrust fluid and may use such currents to navigate.

A robotic eel or fish may comprise acoustic sensors and emitters, as well as radio frequency sensors and emitters. A robotic eel or fish may use flexible material as a component of such sensors and emitters.

Buoyancy for a robotic eel or fish may be provided at least in part by flexible material and/or by one or more displacement volume(s). Displacement volume(s) may comprise, for example, a vacuum, a gas or a liquid that is lighter or heavier than a surrounding thrust fluid. A volume of such vacuum, gas, or liquid may be increased or decreased within the displacement volume, such as by a pump, a piston, a valve or the like. The displacement volume may, for example, occupy one or more sectors of the flexible material. The vacuum, gas, or liquid may be pumped or allowed to pass between within the sectors to relocate the center of displacement of the robotic eel or fish.

The center of mass of the robotic eel or fish may be changed by changing the location of the TRE. The location of the TRE may be changed by, for example, changing the length of different tendons that secure the TRE to the flexible material.

A center of displacement of a robotic eel or fish and/or a center of mass of the robotic eel or fish may be changed to change an orientation of the robotic eel or fish relative to surrounding thrust fluid and/or a gravitational field. Change in orientation of the robotic eel or fish may be performed to steer the robotic eel or fish. Buoyancy may be adjustable, to increase or decrease buoyancy.

A TRE and a battery pack or other power source of a robotic fish or eel may be controlled by a power controller.

The invention claimed is:

1. A robotic eel comprising a plurality of torque reaction engines ("TRE") controlled by a controller, wherein the plurality of TRE each comprise a shaft of an electric engine, a beam of the robotic eel, an inertial mass, the electric engine, and the controller, wherein the shaft of the engine is connected to the beam of the robotic eel, the inertial mass is located around or within the shaft of the engine, wherein the inertial mass comprises a battery, and the electric engine is between or may comprise the inertial mass and the shaft, wherein the electric engine is to obtain an electric power from the battery and, wherein the electric engine is to use the electric power to cause a change in acceleration of the inertial mass relative to the shaft, and wherein torque reaction produced on the shaft by the change in acceleration of the inertial mass relative to the shaft is to cause the shaft and the beam connected to the shaft to rotate, opposite a vector of the change in acceleration of the inertial mass relative to the shaft, and wherein the controller is to operate the plurality of TREs to cyclically reverse the change in acceleration of the inertial mass and to thereby produce cyclic oscillation of the beam, wherein the controller is further to operate the plurality of TREs to produce a wave in the beam of the robotic eel, wherein two of the plurality of TREs are adjoining TREs, wherein a distance between the two adjoining TREs is spanned by the beam, wherein the controller is to cause a first of the two of the adjoining TREs to accelerate a first inertial mass of the first of the two of the adjoining TREs in a first rotational direction, causing a first shaft of the first of the two adjoining TREs to rotate in a first shaft rotational direction.

2. The robotic eel according to claim 1, wherein the wave is one of a standing wave and a traveling wave.

3. The robotic eel according to claim 2, wherein the traveling wave travels up or down the beam of the robotic eel and is to accelerate a thrust fluid surrounding the robotic eel.

4. The robotic eel according to claim 1, wherein the controller is to cause a second of the two of the adjoining TREs to accelerate a second inertial mass of the second of the two of the adjoining TREs in a second rotational direction, causing a second shaft of the second of the two adjoining TREs to rotate in a second shaft rotational direction.

5. The robotic eel according to claim 1, wherein the controller controls at least one of the two adjoining TREs to form at least one of a traveling wave and a standing wave in the beam.

6. The robotic eel of claim 1, wherein the first and second shaft rotational directions have an oscillation phase, and wherein each of the plurality of TREs is controlled by the controller according to an oscillation frequency and an oscillation amplitude.

7. The robotic eel according to claim 4, wherein at least one of the first and second shaft rotational directions bend the beam and cause at least one of a traveling wave and a standing wave in the beam.

8. The robotic eel according to claim 7, wherein the traveling wave causes a thrust fluid surrounding the robotic eel to accelerate and produce thrust.

9. The robotic eel according to claim 7, wherein the standing wave is to steer the robotic eel.

10. The robotic eel according to claim 1, wherein the robotic eel further comprises a fin.

* * * * *